United States Patent [19]

Viviano

[11] 4,013,031

[45] Mar. 22, 1977

[54] APPARATUS TO CONTROL JIB

[76] Inventor: Anthony V. L. Viviano, 141 Athol Ave., Oakland, Calif. 94606

[22] Filed: Mar. 4, 1976

[21] Appl. No.: 663,930

[52] U.S. Cl. ..... 114/204; 114/39; 114/101; 114/102; 254/190 R

[51] Int. Cl.[2] ..... B63H 9/10

[58] Field of Search ..... 114/39, 101, 102, 111, 114/112, 204, 218; 254/190 R

[56] References Cited

UNITED STATES PATENTS

| | | | |
|---|---|---|---|
| 2,453,357 | 11/1948 | Barkley | 114/111 |
| 3,438,349 | 4/1969 | Curtis et al. | 114/102 |
| 3,534,700 | 10/1969 | Marshall | 114/204 |
| 3,623,445 | 11/1971 | Holmes | 114/102 |

FOREIGN PATENTS OR APPLICATIONS

| | | | |
|---|---|---|---|
| 129,226 | 8/1950 | Sweden | 114/204 |

*Primary Examiner*—Trygve M. Blix
*Assistant Examiner*—Charles E. Frankfort

[57] ABSTRACT

A jib sheet apparatus for sailboats which will permit a jib sheet, and thus a head sail of any size, to be trimmed from one side of a sailboat to the other, as in tacking or jibbing, by use of a continuous, closed traveller-track and fairlead apparatus system which requires simply a single, unskilled crewperson of but average strength and manual dexterity to operate, and which can be operated from a single position in the cockpit with minimum effort, or in an alternative mode, by electricity.

4 Claims, 5 Drawing Figures

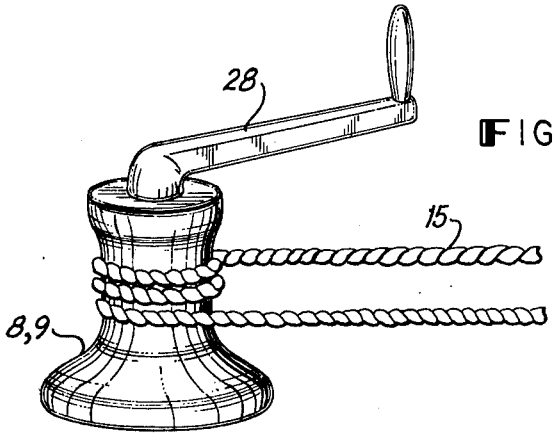
FIG. 4
FIG. 5
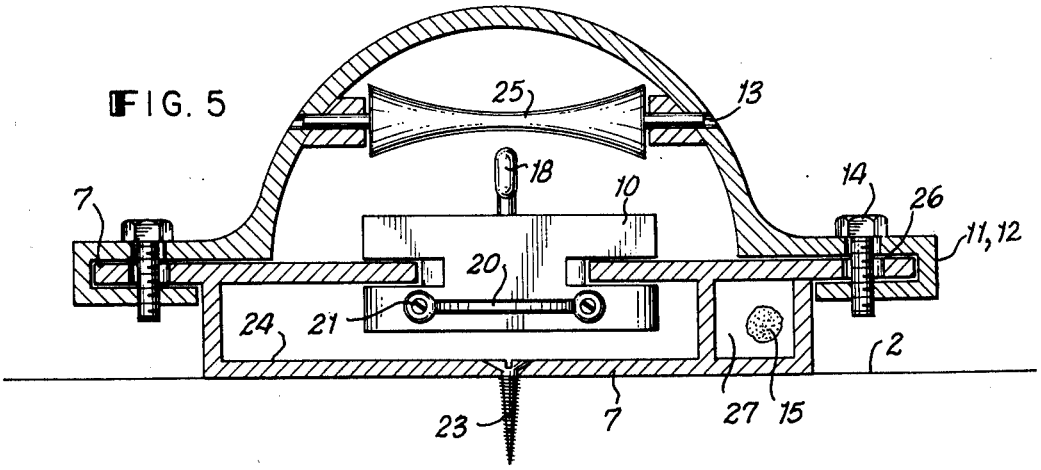
FIG. 1
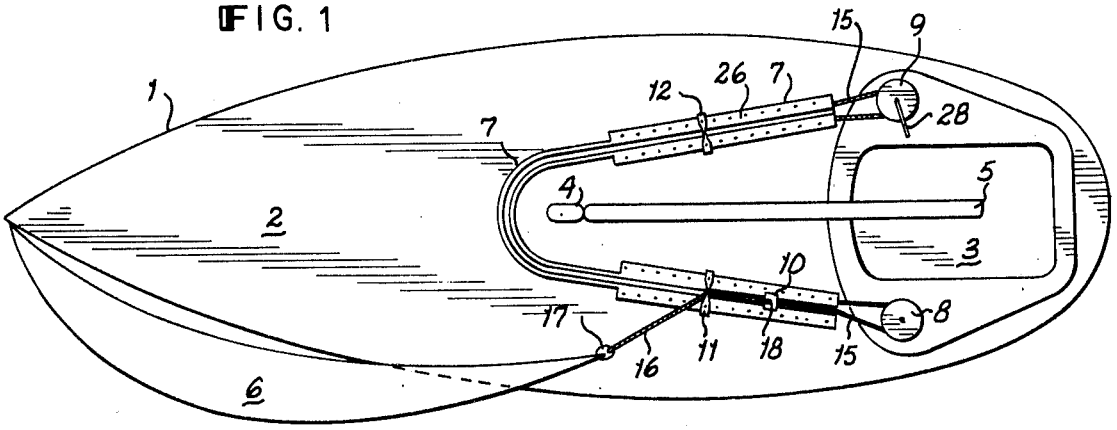

APPARATUS TO CONTROL JIB

BACKGROUND OF THE INVENTION

1. Field Of The Invention

The present invention relates generally to the art of sailing and more particularly to a new and improved apparatus for handling and trimming jib sheets.

2. Description Of The Prior Art

Known jib sheet deck and cockpit arrangements for both small and large sailboats are complicated, untidy and require, in the case of large racing and cruising sailboats, cumbersome and highly expensive jib sheet apparatus, additionally, known apparatus used in the control of jib sheets and through these same sheets, control of the fore sails, can require as many as four or more strong, agile and skilled crewpersons if the known apparatus is to be operated properly. Further, changing the position of the jib, as in tacking, requires that crewpersons shift their positions from one side of the boat to the other in order to apply themselves to the task of operating the jib sheet apparatus. This movement, which almost always is accompanied by a great deal of pulling and tugging, often must be done with alacrity and can cause confusion and inconvenience and sometimes danger, for both crew and passengers, as anyone who has crewed on an ocean going sailboat in high winds and heavy seas can tell you. Known apparatus also forces the placement of winches etc. in inconvenient and obstructive places on the deck and cockpit of the sailboat.

SUMMARY OF THE INVENTION

It is a major object of the present invention to provide a jib sheet apparatus for sailboats which will permit a jib sheet, and thus a head sail of any size, to be trimmed from one side of a sailboat to the other, as in tacking or jybing, by use of a continuous, closed traveller-track and fairlead apparatus system which requires simply a single, unskilled crewperson of but average strength and manual dexterity to operate, and which can be operated from a single position in the cockpit with minimum effort, or in an alternative mode, by electricity.

BRIEF DESCRIPTION OF THE DRAWINGS

FIG. 1 : Illustrates a plan view of a sailboat and the relationship of the traveller-track apparatus to the sailboat deck.

FIG. 4 : Illustrates an isometric view of the port/starboard winch assembly and the control line.

FIG. 5 : Illustrates a cross sectional view taken through the track showing the car and the fairlead assembly.

As shown in the drawings, the present invention is embodied in a traveller-track apparatus and winch arrangement indicated generally in FIG. 1 and FIG. 2, comprising an elongated and linearly sectioned track 7, a car 10, a port winch 8, and a starboard winch 9, two turnbuckles 19, a control line 15, a number of flathead screws 23, two straps 20, a swivel eye 18, and two fairleads 11, 12, FIG. 1 shows a sailboat hull 1, a deck 2, a cockpit 3, a mast 4, a mainsail boom 5, a jib sail 6, a jib sheet 16, a winch handle 28, and a jib clew 17, and one preferred embodiment of the present invention.

Figure 2:
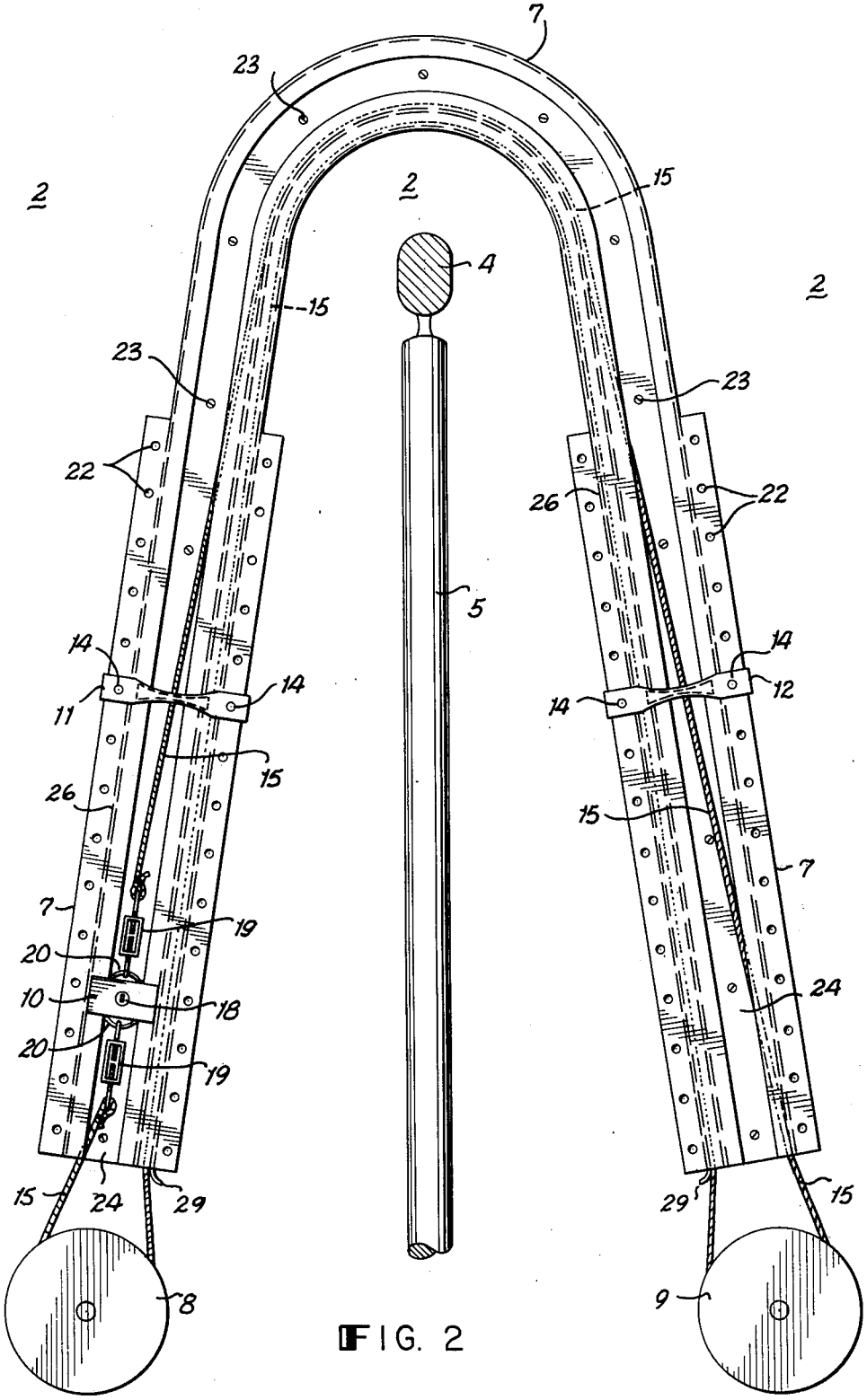
FIG. 2 : Illustrates and enlarged and more detailed plan view of the traveller-track apparatus, showing interrelationship of all parts

The traveller-track apparatus 7 is positioned and affixed to the deck 2, in such a manner that the track 7 describes an elongated arc around the mast 4 which may be considered to begin on the starboard deck 2 just forward of the starboard winch 9, running therefrom forward to somewhat forward of the mast 4, turning in a sweeping arc aft around the mast 4, and continuing aft along the deck 2 until terminating just forward of the port winch 8.

The track 7 is affixed to the deck 2 by flush fitting flathead screws 23 spaced at appropiate intervals along the centerline of the track 7.

Figure 3:
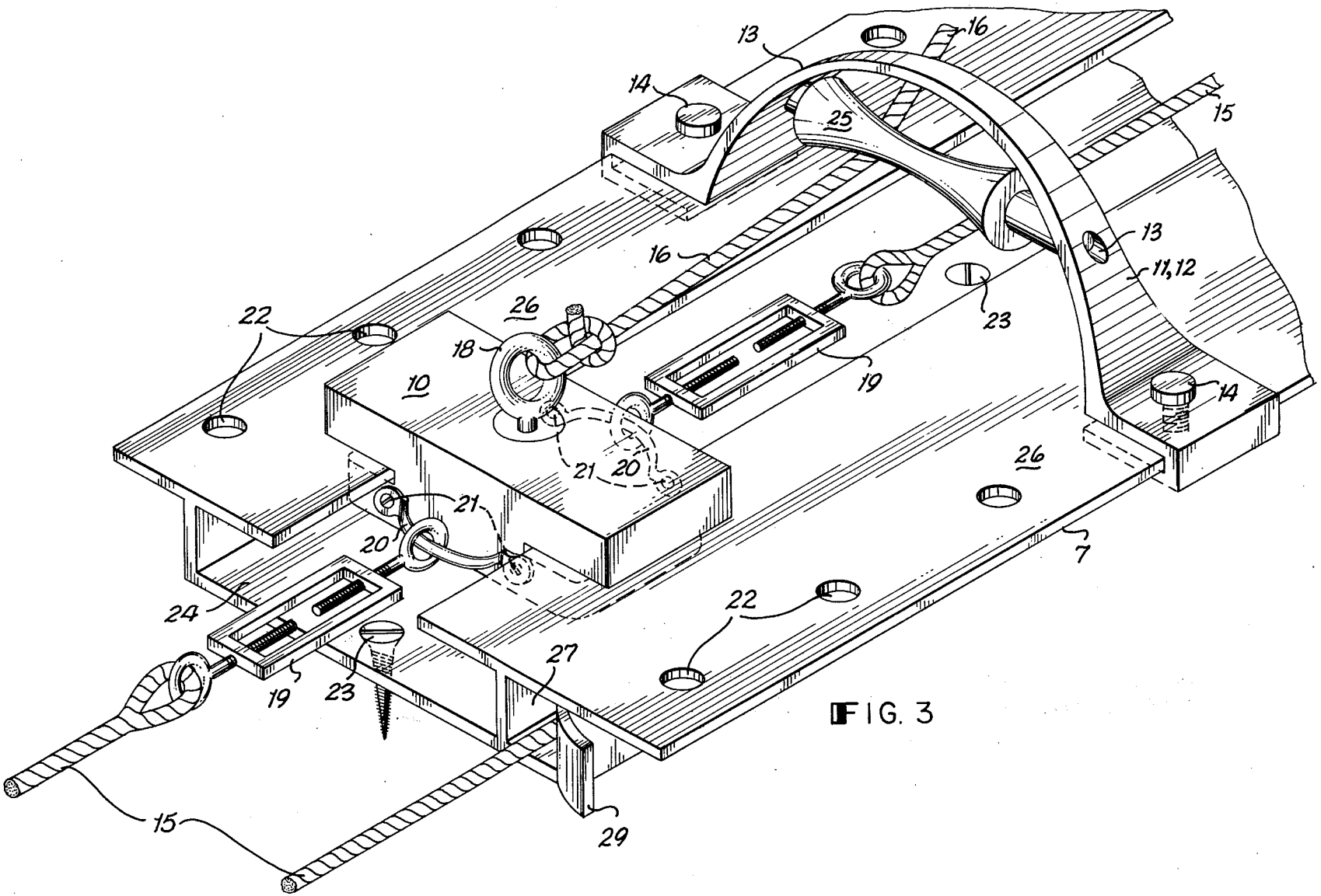
FIG. 3 : Illustrates an enlarged isometric view of a portion of the traveller-track apparatus, showing the control line, car, track, extrusions, fairlead, jib sheet and related hardware

The car 10, shown in FIG. 1, FIG. 2, FIG. 5 and greatly enlarged in FIG. 3, is positioned on and in the track 7 by means of its slotted body shown in FIG. 3 and FIG. 5 and is free to move easily along the entire length of the track 7. The car 10 is moved and positioned anywhere on the track 7 by use of the control line 15 which is affixed to it on both fore and aft verticle surfaces by turnbuckles 19 and straps 20.

A swivel eye 18 shown in detail in FIG. 3 and FIG. 5, is affixed by welding or other suitable method to the top of the car 10 and serves as a fitting upon which is secured the inboard end of the the jib sheet 16. The outboard end of the jib sheet 16 is secured to the clew 17 of the jib 6.

The control line 15 is situated for most of its length in the interior section 27 and 24 of the track 7 such that, with the car 10 positioned on the port side section of the track 7, starting from the forward turnbuckle 19 and running forward, the control line 15 follows along in the interior section 24 of the track 7 its entire length to the end of the track 7 which is located on the starboard side of the deck 2, at which point the control line 15 exits the track 7 thereupon tightly encircling winch 9 three or more times (as shown in FIG. 4) whereupon the control line 15 then reenters the track 7 at interior section 27 again following the track 7 along its length to the end of track 7 which is located on the port side of the deck 2 at which point the control line 15 again exits the track 7 thereupon tightly encircling winch 8 three or more times (as shown in FIG. 4), whereupon the control line 15 again reenters the track 7 at interior section 24 following along in interior section 24 of the track 7 until the control line 15 is terminated by being secured to the aft turnbuckle 19 thus completing a continuous, closed pulley system.

The turnbuckles 19 which are interposed between each end of the control line 15 and the straps 20 — which are secured to both the fore-and-aft verticle surfaces of the car 10 by set screws 20 — serve not only to connect each end of the control line 15 to the straps 20 and thus the car 10, but also enable the control line 15 to be properly tensioned.

The winches 8, 9 shown in FIG. 1, FIG. 2, FIG. 4 when rotated cause the car 10 to move in whichever direction the winches 8, 9 themselves are rotated and whatever speed the winches 8, 9 are rotated. The winches 8, 9 also prevent movement of the car 10 once it has been positioned in a working location because proper tensioning of the control line 15 by use of the turnbuckles 19 will inhibit undesireable slippage of the control line 15 at the winches 8, 9.

The winches 8, 9 themselves are rotated by use of a winch handle 28 which is fitted in the usual manner to either one or both winches 8, 9 and is operated by a single crewperson (not shown). The rotation of either winch 8 or 9 acts upon the control line 15, the turnbuckles 19, the straps 20 and the car 10 to cause the rotation of the other winch 8 or 9. Thus all the components of the entire apparatus and arrangement operate as a closed, continuous system which requires a minimal consumption of energy.

In an alternative mode (not shown) the winches 8, 9 are rotated electrically by an integrally mounted motor which is remotely wired to a control switch which is positioned at any convenient location and operated by any crewperson.

In FIG. 1, FIG. 2, FIG. 3 and FIG. 5 is shown a novel fairlead assembly 11, 12 (two of which are utilized in the present invention). In the present invention two such faileads 11, 12 are utilized, one of which 11 is positioned on the port side of the track 7 and one 12 on the starboard side of the track 7. Each fairlead, 11, 12 consists of a sturdy, cast arch with horizontally slotted feet, each foot set with a screw type pin 14, a roller 25 set on a shaft 13 within the upper part of the arch which is free spinning and is intended to facilitate trimming of the jib sheet 16.

The entire fairlead assembly 11, 12 is mounted, by use of its slotted feet, on the extrusions 26 which protrude from the top of the track 7 horizontally from both sides and which run forward from the very end of the port and starboard track 7 sections to a point just aft of the mast 4. To position the fairlead 11, 12 the screw type pins 14 are unscrewed until they just clear the track extrusion 26. The fairlead, 11, 12 is then free to be slid forward or aft on the extrusion 26 to any desired position. The screw type pins 14 are then lined up with the appropiate pin holes 22 in the extrusion 26 and the screw type pins 14 are then screwed all the way down. The fairlead 11, 12 is thus held immobile and in an upright position.

As can be seen from FIG. 3 and FIG. 5, the fairleads 11, 12 stand upright upon the extrusions 26 because their feet are horizontally slotted and grip the extrusions 26 in such manner and form such a wide base that the fairlead 11, 12 cannot be caused to fall over. From these same drawings it can be seen that the fairleads 11, 12 are arched high enough so that the car 10, including the swivel eye 18 pulling the sheet 16 along behind it can easily pass under and through the fairlead 11, 12 in operation as in tacking.

In operation, as in tacking from a starboard tack — shown in FIG. 1 — to a port tack, the car 10 is caused to move forward by the action of the winch 8 or 9 on the control line 15. The car 10, riding on and in the track 7 by means of its slotted body moves forward under the fairlead 11 pulling the jib sheet 16 along behind it. The car 10 continues to be moved forward in the track 7 around and forward of the mast 4 and thence aft on the starboard side of the track 7, under the starboard fairlead 12 to a position aft of the fairlead 12 which causes the jib sheet 16 to be extended and tensioned against the wind loading of the jib 6 and to be correctly trimmed by the fairlead 12 because the jib sheet 16 is snubbed by the roller 25 in the fairlead 12.

The present invention in operation in one preferred mode, utilizes simply one crewperson stationed at either port winch 8 or starboard winch 9. Upon commencing a tack or jybe the crewperson cranks the winch handle 28 in the appropiate direction causing both winches 8 and 9 to turn in the same direction because they are tied together by the continuous, closed control line 15 system.

Quite simply, the present novel apparatus and arrangement of a traveller-track with extrusions 7, a car 10, a control line 15, turnbuckles 19, straps 20, winches 8, 9 and fairleads 11, 12, allows a sailboat to change course to any point of sail without requiring that several crewpersons, all in a highly active state, occupy the cockpit 3 at the same time and just at the time that the sailboat itself 1, is most active in the sea with not only severe hull 1 movement and horizontal deck 2 inclination, but highly hazardous main boom 5 movement directly overhead. It is at these times that a sailboat 1 and crew are most vulnerable to mishaps and possible catastrophe.

The present novel apparatus and arrangement fosters an uncrowded cockpit 3, minimal physical activity and exertion by but a single person in resetting the jib 6 as in tacking or jybing — virtually no physical activity or exertion in the electrically driven winch 8, 9 mode — , the capability of completing any number of tacks or jybes by operating either winch 8 or 9 and thus avoiding the somewhat risky "low-side" cranking operation, the precise trimming of any sized jib 6 for any point of sail or any wind condition by a "one-time" placement of the novel fairleads 11, 12, and because my new and novel apparatus and arrangement obviates the necessity of two jib sheets 16 having to be alternately released and snubbed around the winches 8, 9 as in old, known methods of tacking and jybing, the facility of sailing large sailboats long distances single handed or short handed in heavy weather is greatly enhanced. The present novel apparatus and arrangement makes possible a much greater ease of sailing on all sizes of boats because it becomes no longer necessary, as in the old, known methods of tacking and jybing, to let go one jib sheet snubbed directly to a winch (not shown) at just the precise moment in a tack or jybe, pull rapidly at the opposite sheet while avoiding "wraps" at the winch, maintain tension of the bitter end of the sheet while cranking the winch against the billowing jib, all the while the sailboat is heeling at an uncomfortable and potentially dangerous angle.

Various modifications and changes to my invention may be suggested from the foregoing detailed description without departing from the spirit of the present invention such as:

providing the winches 8, 9 with friction brakes or rachet stops to insure an even more positive positioning of the car 10 in anticipation of extreme and peculiar wind loading conditions of the jib 6; a camcleat or similar mechanism is substituted for the swivel eye 18 as an individual preference; the interior section 27 of the track 7 is split off from the interior section 24 of the track 7 and affixed to the deck 2 in any other preferred, workable pattern or location.

I claim:

1. A linearly, internally sectioned, slotted traveller-track apparatus with linear, horizontal, perforated extrusions, affixed to a sailboat, such that when viewed from above, said traveller-track can be seen to describe an inverted U-shaped arc, one leg of which begins in the aft, port side area of a sailboat, runs forward along the port side of the sailboat in the general direction of the bow, curves forward around the port side of the mast of said sailboat and forward of the mast in a sweeping arc which runs in a starboard direction toward the starboard side of the sailboat, and which then turns aft from forward of the mast and continues aft around the starboard side of the mast forming the other leg of the U which continues aft along the starboard side of the sailboat in the general direction of the stern, terminating in the aft starboard area of the sailboat, such that said traveller-track's extrusions parallel only each side of that portion of the length of the traveller-track that lies aft of the mast.

2. A linearly, internally sectioned, slotted traveller-track apparatus as positioned and described in claim 1, upon which and in which is mounted -

A car, having means to affix a jib sheet thereto, and also having means to attach a control line thereto, and said car which can be made to slide back and forth along the entire length of the traveller-track at any desired speed and can be positively positioned at any point on the traveller-track by use of -

A control line which is arranged and positioned in such a way that it forms a continuous and closed pulley system wherein each end is attached to said car, and part of said control line utilizes the internal, linearaly sectioned portions of said traveller-track and said control line utilizes Two winches mounted in the aft port and starboard areas of said sailboat, either of which is rotated in either direction at any desired speed by use of a winch handle turned by a crewperson, and because said winches are made a functional and integral part of the continuous, closed pulley system, which consists of said car, said means to attach said control line to said car, said means to tension the control line, and said control line, all of which are interconnected, the rotation of either winch at any speed and in either direction causes a simultaneous, corresponding rotation in the other winch such that in actual operation, as when the sailboat is tacking, the car is caused to move along the track leading the jib sheet, which is attached to it, under two Fairleads, one of which is mounted on the port side extrusion, and the other which is mounted on the starboard side extrusion, and each of which has means to be mounted on its extrusion in such a manner that said fairleads are held upright at all times and are free to be positioned at any location along the entire length of said extrusions, and also said fairleads have means to be positively positioned on said extrusions in such a manner that said fairleads bridge the traveller-track but provide, however, sufficient clearance to allow the car, in operation as in tacking and dragging the jib sheet along with it, to pass beneath the fairleads such that the jib sheet becomes extended and thus comes under tension because the pull of said car, to which one end of the said sheet is attached, acts against the wind loading of the jib, to which, at the jib clew, the other end of said sheet is attached such that said jib sheet is deflected by said fairlead, and because said fairlead itself is positioned on said extrusion to accomplish the best trim of the sail, said deflection causes the said sail to be "sheeted" to its most efficient configuration.

3. A car, which rides upon and in a slotted, curved track positioned and affixed upon the superstructure of a sailboat such that said car, when caused to traverse the entire length of said track, for the purpose of trimming a jib sheet as in tacking, follows a course which takes said car from one aft, side area of the sailboat to the other aft, side area of said sailboat by a route which lies forward of the mast, and said car is comprised of A body having rounded corners to prevent binding on said curved track, and said body is of a size and configuration which permits it to travel under and through the span of a fairlead, mounted across said track, and two connecting means, each of which is mounted to a lower vertical, fore-and-aft surface of the body of said car, for affixing to said car a control line, and means mounted on a top horizontal surface of said car for affixing to said car a jib sheet for trimming a working jib said.

4. A fairlead which sits in an upright position on an extrusion of a traveller-track apparatus such that a body portion of said fairlead forms a bridge-like arch which permits the traveller-track apparatus to be positioned to run under and through the span of the arch of said body portion of said fairlead, and provides for sufficient vertical and horizontal clearance as to permit a car, mounted on and in said traveller-track apparatus, to also run under and through the span of the arch of said body portion, as in tacking a jib sheet, and said fairlead being of sturdy construction such that said fairlead is capable of withstanding snubbing forces exerted upon it by a working jib sheet attached to a jib which is wind-loaded, and said fairlead terminating at each end in a foot which grips each extrusion in such a manner that said fairlead is held in an upright position under all operative stresses, and said fairlead includes means to positively position said fairlead anywhere along said extrusion and means mounted within an upper portion of the arch of said body portion of said fairlead to snub an extended and tensioned working jib sheet, and through said jib sheet trim a working jib sail.

* * * * *